US006568331B2

(12) United States Patent
Hofmann et al.

(10) Patent No.: US 6,568,331 B2
(45) Date of Patent: May 27, 2003

(54) ELECTRICAL IGNITER CAP

(75) Inventors: Heinz Hofmann, Schnaittach (DE); Eugen Feuerstake, Eltersdorf (DE); Karl Rudolf, Schrobenhausen (DE)

(73) Assignee: Diehl Munitionssysteme GmbH & Co. KG., Röthenbach (DE)

( * ) Notice: Subject to any disclaimer, the term of this patent is extended or adjusted under 35 U.S.C. 154(b) by 0 days.

(21) Appl. No.: 10/020,467

(22) Filed: Oct. 29, 2001

(65) Prior Publication Data

US 2002/0056396 A1 May 16, 2002

(30) Foreign Application Priority Data

Nov. 4, 2000 (DE) ..... 100 54 779

(51) Int. Cl.[7] ..... C06D 5/00; F42C 11/00; F42C 19/12; F42B 3/10; F42B 3/12; F42B 10/00; F42B 12/00; F42B 3/00; F42B 30/00; F42B 5/02; F42B 7/02; F42B 5/26; F42B 5/30; F42B 5/08

(52) U.S. Cl. ..... 102/464; 102/200; 102/202.5; 102/202.7; 102/202.14; 102/430; 102/472; 102/530

(58) Field of Search ..... 102/202.5, 202.9, 102/202.14, 472, 530

(56) References Cited

U.S. PATENT DOCUMENTS

| | | | | | |
|---|---|---|---|---|---|
| 3,541,961 | A | * | 11/1970 | Larson | 102/28 |
| 4,150,266 | A | * | 4/1979 | Patrichi | 200/61.08 |
| 4,386,567 | A | * | 6/1983 | Ciccone et al. | 102/202.5 |
| 5,603,525 | A | * | 2/1997 | Zakula | 280/737 |
| 5,871,346 | A | * | 2/1999 | Stephenson | 431/365 |

* cited by examiner

*Primary Examiner*—Michael J. Carone
*Assistant Examiner*—H. A. Blackner
(74) *Attorney, Agent, or Firm*—Scully, Scott, Murphy & Presser

(57) ABSTRACT

An electrical igniter cap has a reproducible igniter characteristic by virtue of the fact that, at the firing side, an igniter unit 20 is covered by a sheeting of plastic material 21 which is rupture-resistant but tears quickly, and also at the firing side it bears against a sieve plate 28 with defined hole cross-sections.

5 Claims, 1 Drawing Sheet

ELECTRICAL IGNITER CAP

BACKGROUND OF THE INVENTION

1. Field of the Invention

The invention relates to an electrical igniter cap which includes a housing, a bursting charge, an igniter unit and an electrical firing device.

2. Discussion of the Prior Art

In accordance with an unpublished data specification sheet an electrical igniter cap comprises a housing which, besides the electrical firing device, contains two igniter charges and a bursting or explosion charge. Those igniter charges involve major fluctuations in terms of firing power and performance. Because of an excessively a id pressure rise and an excessively high gas pressure peak, a large number of cartridge case failures occurred. The igniter unit does not have any cover member so that loosening thereof occurred when drop tests were carried out. Drop tests therefore resulted in the igniter cap being fired.

SUMMARY OF THE INVENTION

The object of the invention is to propose an electrical igniter cap which reliably ignites propellent charge powder, which affords a uniform output performance and which is safe.

That object is attained by the invention in that between the bursting charge and the igniter unit there is arranged a sieve plate with a foil of plastic material, which foil is rupture-resistant but tears easily.

In accordance with the invention, no faults occur in the igniter cap after an environmental test such as a jolt test and drop tests. No gap or crack formation occurs, which could result in premature firing. The firing output performance is reproducible. The gas pressure curve is in a range which ensures reliable ignition of the bursting charge comprising propellent charge powder.

Essential aspects in this respect are the sieve or screening plate with sufficiently large gas openings and the plastic sheeting which is resistant to rupture but which tears quickly. The plastic sheeting therefore tears in a defined manner in the cross-sections of the gas openings.

In accordance with a specific feature, the sieve plate bears with a predetermined pressing force against the plastic sheeting causes the igniter unit or composition to bear firmly against the electrical firing device. No crack or gap formation can therefore occur in the region of the igniter unit.

In accordance with another feature, the arrangement has sufficiently large hole cross-sections for the gases of the igniter unit.

The firing wire bridge embedded in the igniter unit, as set forth herein, ensures reliable ignition of the igniter unit. It is enclosed except for the pole surface by the igniter unit. That means that the arrangement affords a large igniter surface area.

In accordance with a specific aspect the plastic foil comprises HDPE (high density polyethylene). It can also comprise another suitable plastic material.

BRIEF DESCRIPTION OF THE DRAWING

An embodiment of the invention is described hereinafter and illustrated in the drawing.

DETAILED DESCRIPTION OF A PREFERRED EMBODIMENT

Figure 1:
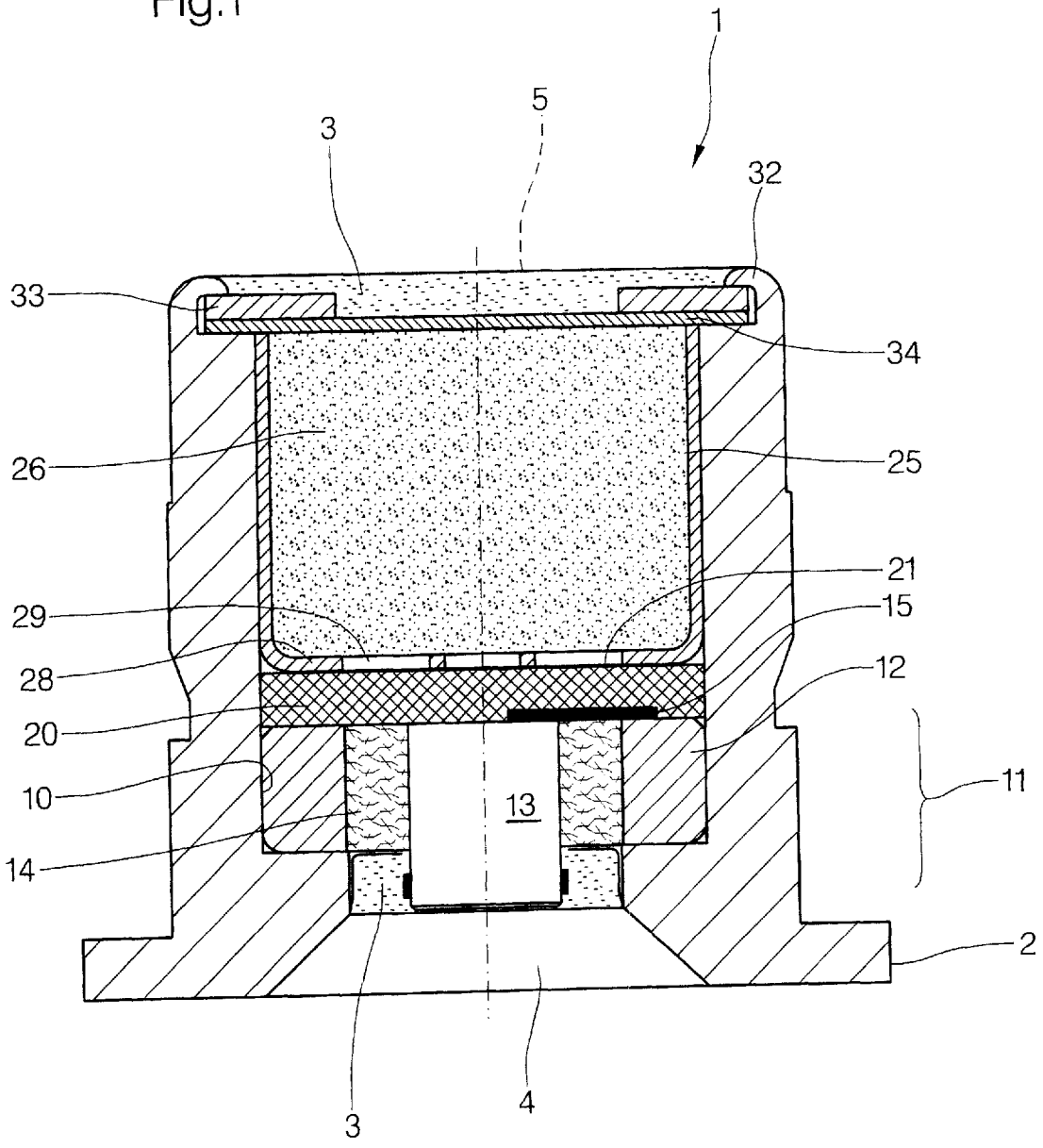

An electrical igniter cap 1 comprises a housing 2 which has openings 4, 5 closed by lacquer 3, at both ends.

Supported in a receiving bore 10 are an electrical firing device 11 with pole bodies 12, 13 and an insulating ring 14 disposed therebetween. An eccentrically disposed firing wire bridge 15 is soldered to the pole bodies 12, 13 in known manner.

An igniter composition or unit 20 is pressed on to the electrical firing device 11 and encases the firing wire bridge 15.

The igniter unit 20 is covered by a plastic sheeting 21 which is resistant to rupture but which tears quickly, comprising high density polyethylene (HDPE).

A cup 25 is pressed into the receiving bore 10 and contains a bursting or explosion charge 26. The cup 25 is in the form of a sieve plate 28 at its bottom. The cross-sections of the gas flow openings 29 amount to 50% of the cross-section (not shown) of the receiving bore 10.

A flanged edge 32 fixes a ring 33 and a disc 34. That provides that the cup 25 is fixed in position and, by way of the sieve plate 28, presses the plastic sheeting 21 and the igniter unit 20 against the pole bodies 12, 13, with a certain biasing force.

Jolt tests and drop tests therefore do not have any influence on the strength and firmness of the igniter unit 20.

Upon firing of the igniter unit 20, at a certain gas pressure the plastic sheet portions disposed in the region of the gas flow openings 29 abruptly tear and the bursting charge 26 is ignited over a large area. The gas pressure of the bursting charge 26 destroys the disc 34 and the lacquer 3.

The igniter cap 1 has a comparatively large bursting charge 26, more specifically being of the same structural length as the known igniter cap. That is achieved primarily by a saving of space insofar as the igniter cap 1 according to the invention has only one single igniter unit 20.

The functions of the plastic sheeting 21 are to hold the igniter unit 20 and to provide for substantially uniform ignition of the igniter unit 20. The firing wire bridge 15 fires asymmetrically. Due to the retarding, damming action of the plastic sheeting 21, the igniter unit 20 is fired therethrough, over its entire cross-section. Ignition of the bursting charge 26 therefore takes place through all gas flow openings 29 and not just through a part thereof. The plastic sheeting 21 can also comprise plastic material or metal such as copper, aluminium, or a suitable composite material.

What is claimed is:

1. An electrical igniter cap (1) comprising a housing (2), a bursting charge (26), an igniter unit (20) and an electrical firing device (11), a sieve plate (28) with a sheeting (21) constituted of plastic material which is rupture-resistant and rapid-tearing being interposed between said bursting charge (26) said igniter unit (20) said sieve plate (28) being a constituent of a cup (25) surrounding the bursting charge (26) and being secured by ring and disc elements (33, 34) which are retained by a flange (32) on said cup.

2. An igniter cap according to claim 1, wherein the sieve plate (28) has openings, which have cross-sections which are 30–70% of the cross-section of a receiving bore (10) for said electrical firing device (11).

3. An igniter cap according to claim 1, wherein a firing wire bridge (15) is embedded in the igniter unit (20).

4. An igniter cap according to claim 1, wherein said plastic sheeting (21) comprises high density polyethylene (HDPE).

5. An igniter cap according to claim 1, wherein said plastic sheeting comprises a composite material.

* * * * *